US010683123B2

(12) United States Patent
Potter

(10) Patent No.: US 10,683,123 B2
(45) Date of Patent: Jun. 16, 2020

(54) PACKAGING SYSTEM

(75) Inventor: Trevor Potter, Portadown Armagh (GB)

(73) Assignee: Rovipak Packaging Solutions Limited, Portadown (GB)

( * ) Notice: Subject to any disclaimer, the term of this patent is extended or adjusted under 35 U.S.C. 154(b) by 403 days.

(21) Appl. No.: 13/979,074

(22) PCT Filed: Jan. 11, 2012

(86) PCT No.: PCT/EP2012/050350
§ 371 (c)(1),
(2), (4) Date: Jul. 10, 2013

(87) PCT Pub. No.: WO2012/095446
PCT Pub. Date: Jul. 19, 2012

(65) Prior Publication Data

US 2013/0283732 A1 Oct. 31, 2013

(30) Foreign Application Priority Data

Jan. 11, 2011 (GB) ..... 1100420.7

(51) Int. Cl.
*B65B 5/04* (2006.01)
*B65B 25/06* (2006.01)
*B65B 61/02* (2006.01)

(52) U.S. Cl.
CPC ..... *B65B 61/025* (2013.01); *B65B 5/045* (2013.01); *B65B 25/064* (2013.01)

(58) Field of Classification Search
CPC ..... B25B 5/022; B25B 9/20; B25B 25/064; B25B 61/025; B25B 61/26; B65B 61/02;
(Continued)

(56) References Cited

U.S. PATENT DOCUMENTS 2,656,658 A * 10/1953 Grady ..... B65B 9/15 383/120
3,194,710 A * 7/1965 Stremke ..... B65C 9/02 156/360

(Continued)

FOREIGN PATENT DOCUMENTS

FR 2348855 11/1977

OTHER PUBLICATIONS

Succession—Definition and More from the Free Merriam-Webster Dictionary https://www.merriam-webster.com/dictionary/succession Wayback Machine to Feb. 20, 2010.*

(Continued)

*Primary Examiner* — Robert F Long
*Assistant Examiner* — Patrick B Fry
(74) *Attorney, Agent, or Firm* — Warner Norcross + Judd LLP

(57) ABSTRACT

A packaging system for individually packaging a succession of products, especially poultry, into bags, for example quad seal bags. The system comprises a packaging apparatus, a weighing apparatus and a printer. The weighing apparatus is located adjacent the packaging apparatus such that the weighed product is the next product to be packaged by the packaging apparatus. The printer prints information relating to the weight of the weighed product directly onto the packaging material for the weighed product, or onto a label for the weighed product. Since the product is weighed just before being packaged, it is ensured that the information printed onto a bag relates to the specific product in the bag.

28 Claims, 5 Drawing Sheets

(58) Field of Classification Search
CPC ..... B65B 61/025; B65B 1/32; B65B 9/20; B65B 9/213; B65B 5/022; B65B 25/064; B65B 61/26
USPC ..... 53/502, 54, 131.4, 131.5, 551
See application file for complete search history.

(56) References Cited

U.S. PATENT DOCUMENTS 3,540,184 A * 11/1970 Ashton ..... B65B 9/15 383/117
3,650,773 A * 3/1972 Bush ..... B65B 61/025 177/4
3,797,199 A * 3/1974 Seifert ..... B65B 9/15 53/255
4,415,048 A * 11/1983 Teraoka ..... B65C 1/02 177/245
4,548,024 A * 10/1985 Fine ..... B65B 11/54 53/136.1
4,709,532 A 12/1987 Taylor
5,009,058 A * 4/1991 Ptaschek ..... B65B 9/15 53/439
5,271,210 A * 12/1993 Tolson ..... B65B 61/28 198/343.1
5,684,275 A * 11/1997 Tolson ..... B65C 1/02 177/119
5,758,477 A * 6/1998 Wilson, Jr. ..... B65B 57/14 53/147
5,802,803 A * 9/1998 Kitagawa ..... B65B 57/14 53/504
6,314,706 B1 11/2001 Araki et al.
6,357,210 B1 * 3/2002 Wetter ..... B65B 5/045 53/436
6,416,798 B1 * 7/2002 Gentine ..... B65B 9/20 283/91
6,883,297 B2 * 4/2005 Kirk ..... B65B 9/15 53/131.2
7,127,872 B2 * 10/2006 May ..... B65B 9/15 53/134.1
7,261,130 B2 * 8/2007 Porter ..... B65B 25/06 141/129
7,555,880 B2 * 7/2009 Porter ..... B65B 25/06 53/443
7,966,793 B2 * 6/2011 Griggs ..... A22C 11/125 53/578
8,096,097 B2 * 1/2012 Haschke ..... A22C 17/0093 426/129
2004/0068964 A1 4/2004 Kirk et al.
2004/0250512 A1 12/2004 May et al.
2011/0094185 A1 4/2011 Haschke

OTHER PUBLICATIONS

Cycle—Definition and More from the Free Merriam-Webster Dictionary https://www.merriam-webster.com/dictionary/cycle Wayback Machine to Apr. 11, 2010.*
PCT International Search Report regarding Application No. PCT/EP2012/050350 filed Jan. 11, 2012, a counterpart to U.S. Appl. No. 13/979,074.
PCT International Written Opinion regarding Application No. PCT/EP2012/050350 filed Jan. 11, 2012, a counterpart to U.S. Appl. No. 13/979,074.

* cited by examiner

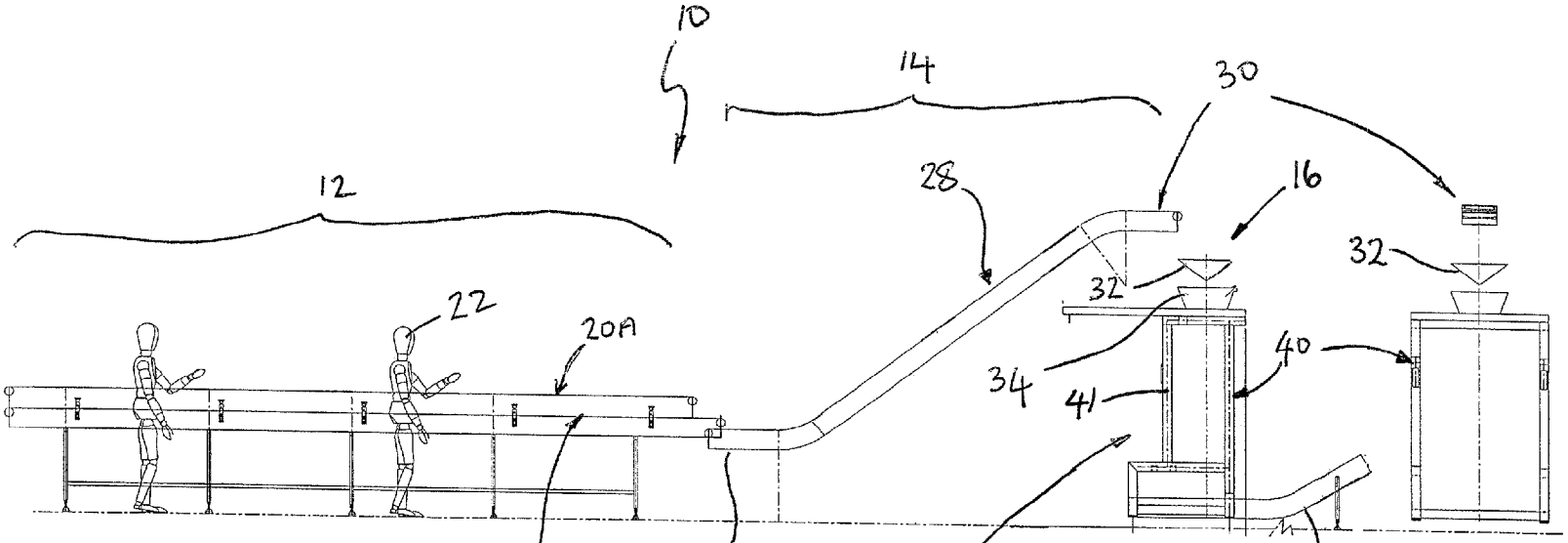
FIG. 1
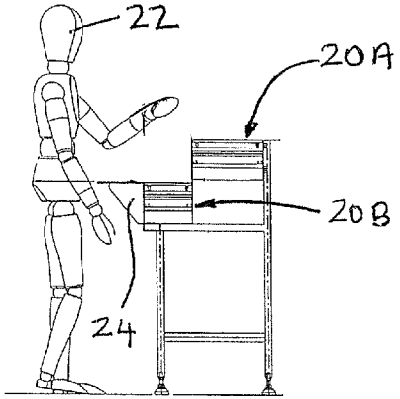
FIG. 2
FIG. 3

PACKAGING SYSTEM

FIELD OF THE INVENTION

The present invention relates to packaging systems. The invention relates particularly to packaging systems for poultry.

BACKGROUND TO THE INVENTION

Conventionally, meat products such as poultry are packaged by placing the product in a plastics tray and wrapping the product and tray with a film, for example a heat shrinkable film. Such packaging is that it is relatively cumbersome and is not environmentally friendly. Another problem is that conventional packaging production lines normally require that the meat products are weighed and labelled after packaging is completed, usually on a separate machine.

It would be desirable to provide a packaging apparatus that mitigated the above-identified problems.

SUMMARY OF THE INVENTION

A first aspect of the invention provides a packaging system as claimed in claim 1. Preferred features of the invention are recited in the dependent claims.

The system may comprise a packaging apparatus, a weighing apparatus, a printer, and means for transferring a weighed product to said packaging apparatus, wherein said weighing apparatus is located adjacent said packaging apparatus such that said weighed product is the next product to be packaged, and wherein said printer is arranged to receive information relating to the weight of said weighed product and to print said information, or information derived therefrom, directly onto the packaging of the weighed and packaged product, or onto a label for the weighed and packaged product.

The packaging system is typically incorporated into a production line for weighing and packaging a plurality of products in succession. The weighing point is adjacent the packaging apparatus, and the arrangement is such that each product is weighed just before being packaged. Advantageously, the product is weighed after the preceding product has been packaged (or at least placed into or otherwise allocated to its respective packaging) such that no other non-packaged products are in the packaging production line between the weighing apparatus and the packaging apparatus. Hence, the weighed product is the next to be packaged and so the weight-related information provided to the printer relates to the product next being packaged.

Preferably, said transferring means comprises a slide or chute arranged to transfer products from the weighing apparatus to said packaging apparatus under the influence of gravity. To this end, the weighing apparatus is preferably located above the packaging apparatus. Optionally, said weighing apparatus comprises a hopper or container coupled to a weighing device. The weighing hopper/container may comprise a first door, or other release mechanism, for selectably holding a product in the hopper/container or releasing the product from the hopper/container. Said first door is preferably held in its holding state while a product is received and weighed, and is opened after the product has been weighed. The preferred arrangement is such that said first door is aligned, or movable into alignment, with said transfer means (preferably the upper end of the chute) so that products leaving the hopper/container via the first door are transferred to the packaging apparatus. The hopper/container may include a second door, or other release mechanism, for selectably holding a product in the hopper/container or releasing the product from the hopper/container. Said second door is preferably held in its holding state while a product is received and weighed, and is opened after the product has been weighed. The second door may be aligned with a rejection area, or means for transferring products to the rejection area. The system may open one or other of said doors after a product has been weighed and in response to determining if the weight of the product meets one or more criterion.

In preferred embodiments, the packaging apparatus comprises a bagging machine, i.e. a machine configured to place the products into individual bags, preferably quad seal bags. The packaging apparatus preferably comprises a vertical form fill and seal machine (sometimes referred to as a VFF seal machine, or a VFF&S machine).

In typical embodiments, the system includes at least one conveyor for delivering products to the weighing apparatus. Said at least one conveyor typically includes an elevating conveyor arranged to elevate the products to a height from which they may be transferred to the weighing apparatus, preferably under the influence of gravity. To this end, it is preferred that the weighing apparatus, and in particular the product receiving portion of the weighing apparatus, is located below the discharging end of the elevating conveyor.

Optionally, a holding hopper is provided between the discharging end of the elevating conveyor and the weighing apparatus.

Typically, a feed conveyor is provided for feeding products to said elevating conveyor.

Said elevating conveyor and, when present, said feed conveyor, are preferably arranged to be index operated, i.e. moved incrementally, conveniently under control of a controller. Typically, said elevating conveyor and, when present, said feed conveyor each comprises a flighted conveyor.

The components of the system are conveniently controlled by a controller, which typically comprises a suitably programmed computer.

In preferred embodiments, the packaging apparatus is configured to make a hermetically sealed 4 corner package (especially of the type known as a quad seal bag), and advantageously includes means for injecting a product preserving gas into the package, e.g. at a level that will satisfy a shelf life of 12-14 days. The package comprises a bag formed from one or more sheets of plastics, e.g. a laminated plastics film. In use, products to be packaged, e.g. fresh, tied tray-less chickens or other poultry products, are provided to the packing apparatus typically from an indexed conveyor system. Each product is weighed, after which it is conveyed via gravity into a forming tube of the packaging apparatus. The package is printed with relevant information, e.g. product weight, date, time, bar code and/or batch code, as required.

A second aspect of the invention provides a poultry package shaped and dimensioned to receive a poultry product, preferably a single bird, said package comprising a bag formed from flexible material, preferably plastics, being sealed in use at opposing ends and preferably having at least one crease on opposing sides extending between said opposing ends. The bag is preferably a quad seal bag.

A third aspect of the invention provides a method of individually packaging a succession of products, especially a poultry products, as claimed in claim 35.

Embodiments of the present invention are particularly suited for packaging meat products, especially poultry products such as chickens, ducks, turkeys etc., particularly whole birds. It will be understood however that the apparatus may alternatively be used to package other products.

Further advantageous aspects of the invention will be apparent to those ordinarily skilled in the art upon review of the following description of a specific embodiment and with reference to the accompanying drawings.

BRIEF DESCRIPTION OF THE DRAWINGS

Embodiments of the invention are now described by way of example and with reference to the accompanying drawings in which like numerals are used to denote like parts and in which:

FIG. 1 is a schematic side view of a packaging apparatus embodying the invention;

FIG. 2 is a first end view of the apparatus of FIG. 1;

FIG. 3 is an opposite end view of the apparatus of FIG. 1;

DETAILED DESCRIPTION OF THE DRAWINGS

Figure 4:
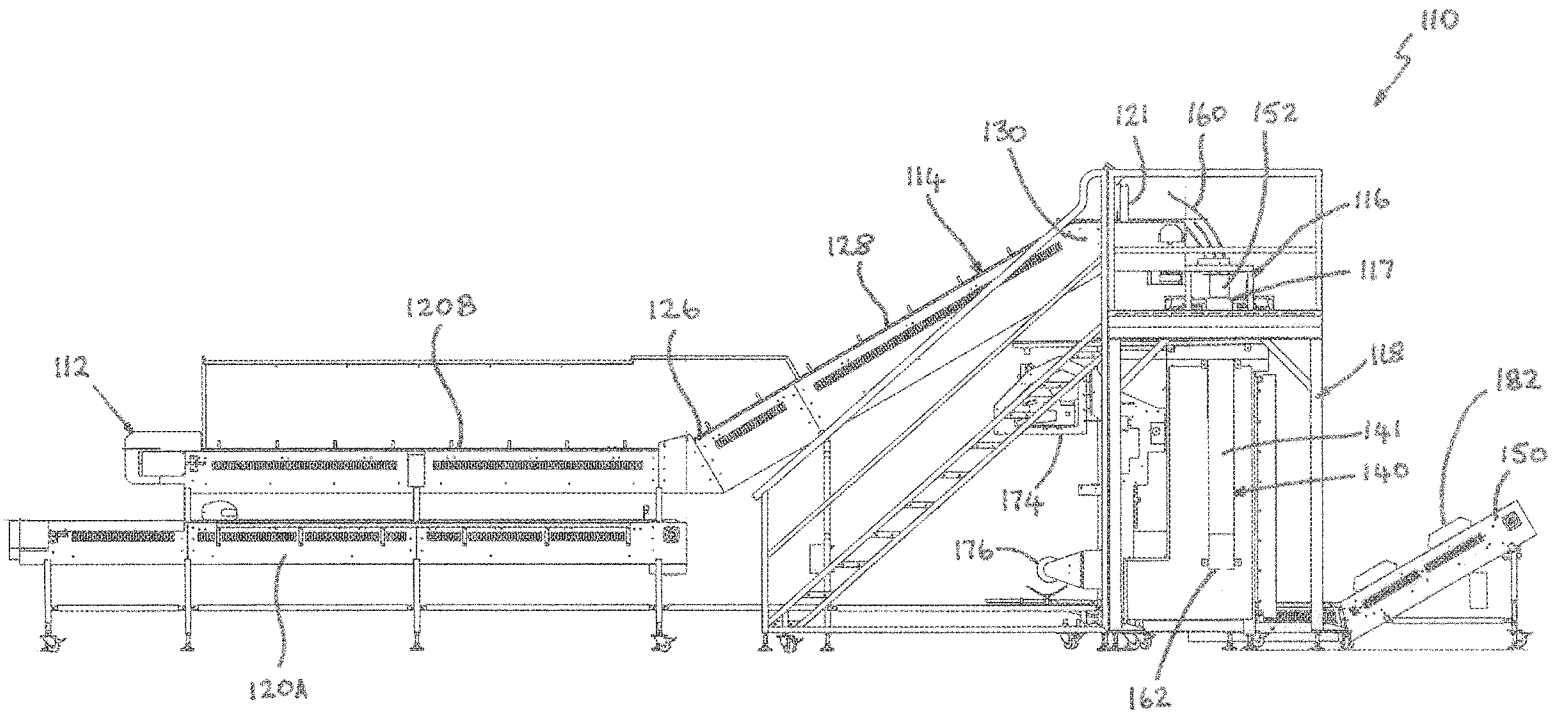
FIG. 4 is a side view of a preferred packaging apparatus embodying the invention.
Figure 5:
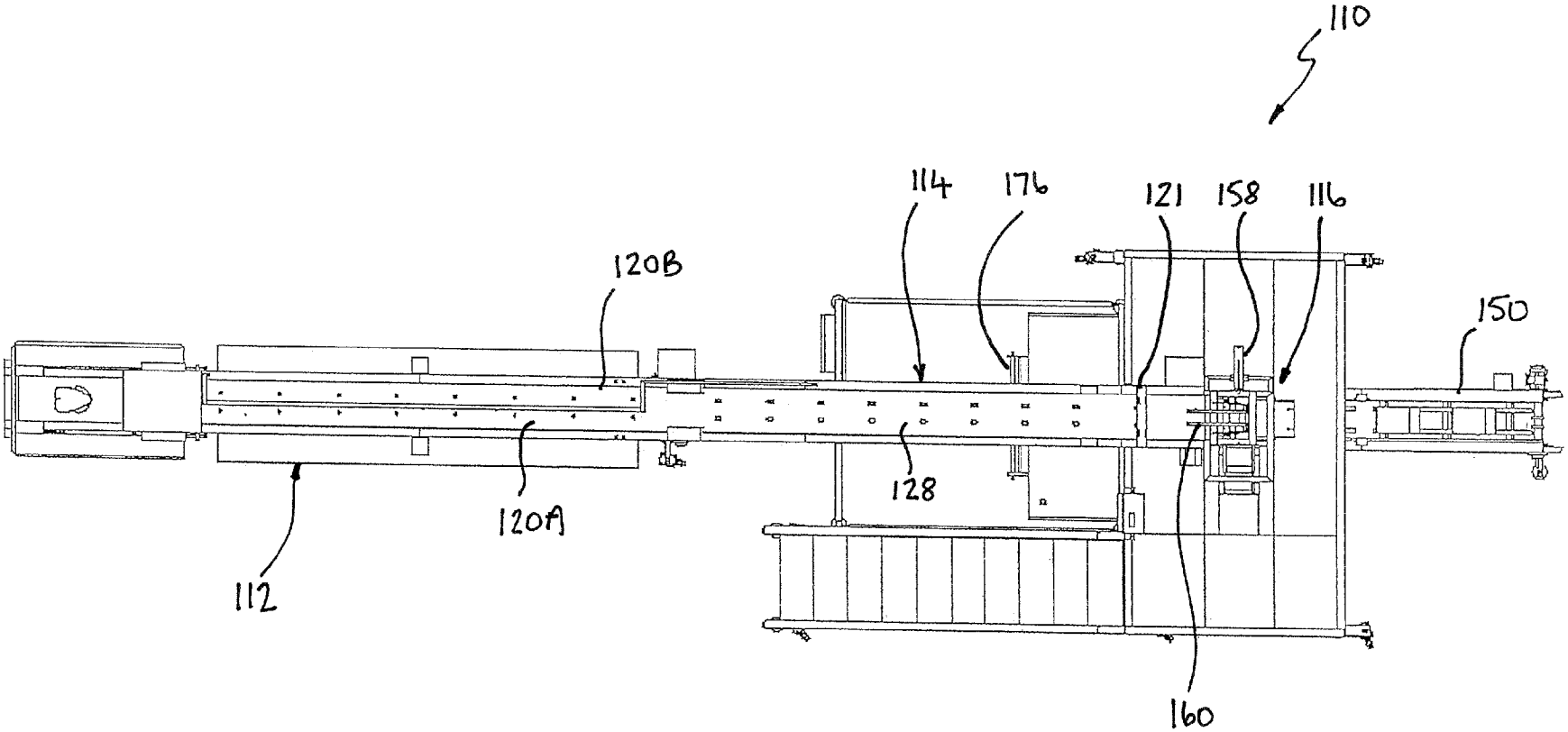
FIG. 5 is a plan view of the apparatus of FIG. 4.

Referring now to the drawings there is shown, generally indicated as 10, a packaging apparatus embodying the invention. In typical embodiments, the apparatus 10 includes a handling station 12, an elevation station 14, a weighing station 16 and a packaging station 18. Embodiments of the invention are particularly suited for use in packaging poultry products, especially whole birds, but may be used for packaging other products.

The handling station 12 comprises one or more conveyors 20 for conveying products towards the packaging station 18. In the preferred embodiment, the handling station 12 includes a bulk conveyor 20A and an indexing conveyor 20B. For ease of use, the bulk conveyor 20A is preferably raised with respect to the indexing conveyor 20B, although this arrangement could be reversed. Alternatively, the conveyors 20A, 20B may be at substantially the same level. The conveyors 20A, 20B run substantially parallel with one another and are located adjacent one another so that products may readily be transferred from one to the other (and in particular from the bulk conveyor 20A to the indexing conveyor 20B) by an operator 22. A tying station, for example in the form of a shelf 24 that projects from the handling station 12, conveniently from the indexing conveyor 20B, may be provided to allow the operator 22 to tie the products, or otherwise process the products during the handling stage. Advantageously, the indexing conveyor 20B is configured for indexing, e.g. flighted indexing in which case the conveyor 20B comprises a plurality of flights (not visible). Typically, each flight comprises a conveying element, e.g. a plate or slat, that extends between parallel driven chains, or other endless loops, or is located on a conveying belt. Adjacent flights are spaced-apart from one another by a fixed distance. Alternatively, indexing may be achieved by any other suitable means, for example by a plurality of parallel, spaced apart dividers extending transversely across the conveyor (which may for example be a belt-type conveyor), or by a plurality of indexing markers spaced apart along the length of the conveyor. One or more sensors (not shown) are provided for detecting the flights (or other indexing markers) in order to implement the indexing. A controller (not shown) controls the drive means for the belt 20B and is typically configured to stop the indexing belt 20B when a sensor detects a flight. The indexing of the conveyor 20B is co-ordinated with the operation of the packaging station 18 by the controller, which may for example comprise a suitably programmed PLC controller, and/or computer(s). Typically, the controller comprises a central computer programmed to co-ordinate the operation of the various components of the system, and being in communication with one or more other computers or processors that control respective system components. The, or each, sensor may also, in conjunction with the controller, be used to monitor production rate by detecting if a flight is empty. If a flight is empty, throughput or efficiency is reduced in comparison to all flights carrying product.

Preferably, the indexing conveyor 20B projects beyond the bulk conveyor 20A in the direction of conveyance and at the end adjacent the elevation station 14.

The conveyors 20A, 20B may take any suitable form, e.g. belt conveyors, and may be driven by any suitable drive means, e.g. shaft mounted motor gearboxes (not shown). The timing of the indexing is advantageously synchronised with the operation of the packaging station 18 by the controller, as is described in more detail hereinafter.

The elevation station 14 comprises an elevating conveyor 28 that has a lower end 26 located and positioned to receive products from the end of the indexing conveyor 20B. The elevating conveyor 28 has an upper end 30 and, between the ends 26, 30, the conveyor 28 comprises an inclined section for raising the products. The conveyor 28 may take any suitable form, e.g. a belt conveyor, and may be driven by any suitable drive means, e.g. shaft mounted motor gearboxes (not shown). The timing of the indexing is advantageously synchronised with the operation of the packaging station 18 by the controller, as is described in more detail hereinafter. The conveyor 28 is also configured for indexing, e.g. comprises a plurality flights or other indexing components, associated with one or more sensors for detecting the flights, and may be driven in an indexed manner under the control of the controller. In this respect the conveyor 28 may be similar to the conveyor 20B and the same descriptions apply. The conveyors 20B, 28 may be indexed independently of the other. To this end the controller may control respective drive means for each conveyor 20B, 28 independently of the other.

A weighing machine (not shown) is provided adjacent the upper end 30 of the conveyor 28 in order to receive products from the conveyor 28 one at a time. The weighing machine is preferably co-operable with, e.g. mechanically coupled to, a weighing hopper 34 in order to weigh the contents of the hopper, as is described in more detail hereinafter.

An intermediate holding hopper 32 may be provided between the conveyor 28 and the weighing hopper 34. Means for transferring products from the end 30 of the conveyor 28 into the intermediate hopper 32 (when present) or directly into the weighing hopper (when the intermediate hopper 32 is not present) are provided and may take any suitable form, e.g. a chute, slide, rollers and/or one or more actuators for pushing the products. Alternatively, products may fall into the hopper 32 or 34 (as applicable) under the influence of gravity. In the preferred embodiment, the weighing hopper 34 is located beneath the intermediate hopper 32.

In use, products are transferred, one at a time, from the conveyor 28 to the intermediate hopper 32. The hopper 32 serves as a buffer, holding the product until the weighing hopper 34 is available. The hopper 32 includes a release mechanism (not shown), e.g. a door, that is opened and closed under the control of the controller by any suitable means, e.g. an actuator. When the product is first received by the hopper 32, the door is closed to retain the product. When the weighing hopper 34 is ready for the product, the door is opened and the product is transferred to the weighing hopper 34. The product may fall from one hopper to the next or may be transferred by any other suitable means, e.g. a slide.

The weighing hopper 34 is preferably incorporated into an independent frame such that it is isolated from vibrations of the system 10. Advantageously, one or more retractable support members, e.g. extendible actuators (not shown), are co-operable with the hopper 34 to engage and hold the hopper 34 as a product is transferred to the hopper 34. The support members are retracted after the product is received by the hopper 34 to allow the weighing machine associated with the hopper 34 to weigh the product. By supporting the hopper 34 while a product is being received, the support member(s) reduce the risk if damage being caused to the weighing device. The support member(s) are conveniently controlled by the controller.

In preferred embodiments, the weighing hopper 34 has a first outlet and a second outlet (not shown), each having a respective door that may be opened or closed under the control of the controller by any suitable means, e.g. a respective actuator (not shown). The first outlet is aligned with a packaging apparatus 40, which is part of the packaging station 18, and the second outlet is aligned with a rejection area, e.g. a bin or conveyor (not shown). The doors are closed while the product is received and weighed. When the product is weighed, if its weight meets the set criteria (e.g. if the weight is within acceptable weight limits), then the first door is opened to allow the product to be transferred to the packaging apparatus 40. If the product is outside of the weight criteria, then the second door is opened to allow the product to be transferred to the rejection area. Conveniently, the hopper 34 is arranged with respect to the rejection area and the packaging apparatus such that products may be transferred under the action of gravity.

In preferred embodiments, the operation of the system 10 is indexed to the operation of the packaging machine 40, for example the controller is programmed to advance the index by one in response to determining that the packaging machine is ready to receive a product. Conveniently, this is achieved by reference to the operation of the weighing hopper 34: when the weighing hopper 34 is ready to receive the next product, i.e. when it is empty and its doors are closed, the controller may take this as an indication that the index may be advanced by one. In response to advancing the index by one, the indexed conveyors 20B, 28 are moved forwards toward the packing station by an appropriate increment such that the next product is transferred to the intermediate hopper 32 (when present) or to the weighing hopper 34. When the intermediate hopper 32 is present, its contents are transferred to the weighing hopper 34 in response to the index being incremented by one.

In preferred embodiments, the packaging apparatus 40 comprises a bagging machine, i.e. a machine configured to place the products into individual bags. In particular, the packaging machine 40 preferably comprises a vertical form fill and seal machine (sometimes referred to as a VFF seal machine, or a VFF&S machine). For example, the packaging apparatus 40 may comprise an AB330 Mark VFF seal machine as provided by Ancholme machinery, North Lincolnshire, England. The apparatus 40 is preferably the type that produces and fills a quad seal bag. The apparatus is configured to operate on sheet plastics, and comprises means to form the sheet plastics into a bag that is open at one end (for the purposes of filling). The apparatus 40 further includes means for heat-sealing the other end of the bag, creasing and folding the sides of the bag between the two ends to create two parallel edges along each side, each edge being heat-sealed. This results in four seals along the sides of the bag, two at each side, hence the name quad seal. The open end of the bag is heat sealed after it has been filled. In use, the product is dropped from the hopper 34 into an open ended bag, which is then sealed. In preferred embodiments, a chute, or forming tube 41, is provided between the weighing hopper 34 and the packaging apparatus 40 for transferring products therebetween.

The packaging station 18 advantageously includes a printer (not shown) for printing information onto the bags. The printer receives information from the weighing machine, directly or via the controller, in respect of each product. Since the hopper 34, and therefore the weighing point, is adjacent the packing station 18, and more particularly beside the packaging apparatus 40, the weight information provided to the printer relates to the product being packaged.

Referring now to FIGS. 4 to 8, there is shown a preferred packaging apparatus 110 embodying the invention. The apparatus 110 is similar to the apparatus 10 and so like numerals are used to indicate like parts and the same description applies unless stated otherwise. The apparatus 110 includes a handling station 112, an elevation station 114, a weighing station 116 and a packaging station 118. The handling station 112 comprises one or more conveyors for conveying products towards the packaging station 118, e.g. a bulk conveyor 120A and an indexing conveyor 120B. In this example the bulk conveyor 120A is at a lower level than the indexing conveyor 120B. The elevation station 114 comprises an elevating conveyor 128 that has a lower end 126 located and positioned to receive products from the end of the indexing conveyor 120B. It will be understood that in alternative embodiments, the handling station and/or the elevation station may be omitted.

Figure 6:
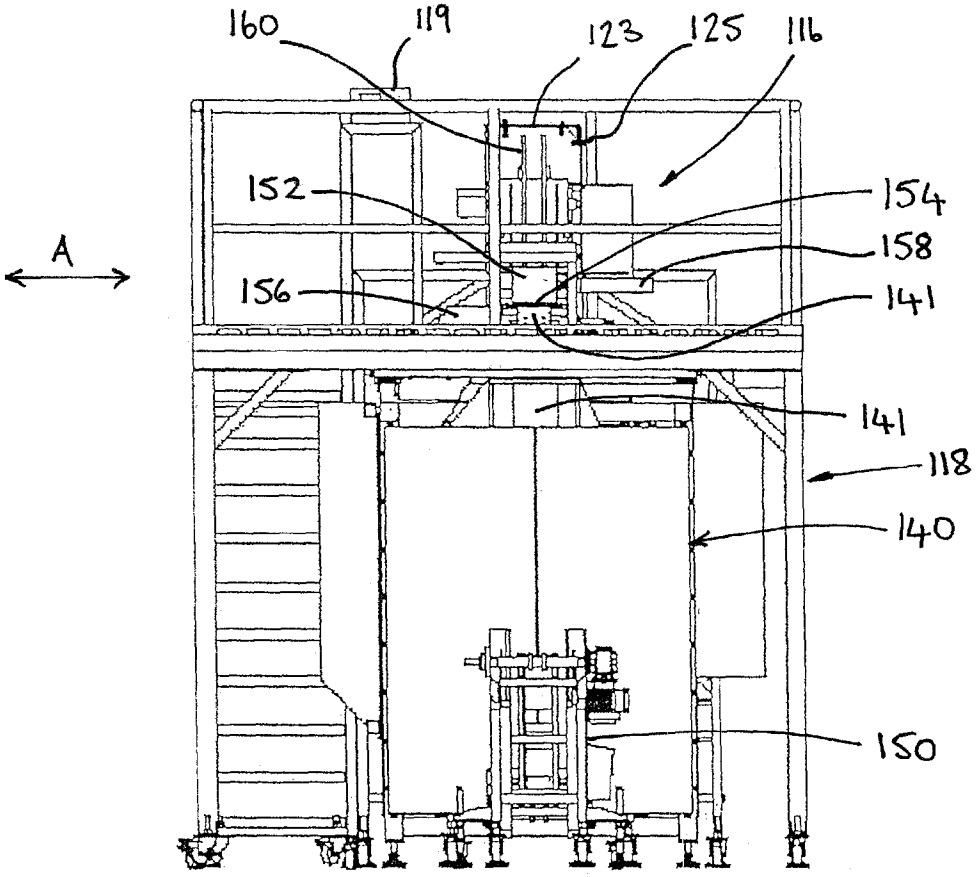
FIG. 6 is an end view of the apparatus of FIG. 4.

FIG. 6 shows the controller, indicated as 119, which in addition to (or instead of as applicable) performing the tasks described above, may also control the operation of the weighing station 116 and packaging station 118, preferably in the manner described below.

Optionally, a sizing apparatus 121 is provided for determining whether or not each product meets one or more size requirements. In this example, the apparatus 121 comprises a frame 123 through which each product passes during use, the frame 123 supporting one or more sensing devices, e.g. optical sensing devices, that are configured to define one or more thresholds for the height and/or width and/or length of the product. For example, a first sensing device 125 (FIG. 6) may be configured to define, e.g. optically, a threshold above the surface, e.g. the conveyor surface, on which the product lies in order to determine if the product's height is greater than or less than the height defined by the threshold. Similarly, a respective pair of laterally spaced apart sensors may be positioned to define respective spaced apart thresholds against which the products width and/or height can be assessed. The output of the sensors is provided to the controller 119, which determines if the product meets one or more relevant size requirements. Products that do not meet the size requirements may be rejected. In the preferred embodiment, rejection of out-sizes products is performed at a later stage as described below. Alternatively, means for rejecting the product may be provided at the sizing apparatus 121. In the preferred embodiment, the sizing apparatus 121 is located before the weighing station 116, preferably at the end 130 of conveyor 128.

The weighing station 116 comprises any suitable weighing apparatus, e.g. an electro-mechanical weighing apparatus, which in the present example is incorporated into a platform 117. A container 152, preferably comprising an open ended sleeve-like body, receives the product during weighing. The container 152 may rest upon the platform 117 during weighing. A first door 154 is provided in the platform 117. The door 154 is located at the top of the forming chute 141. When the door 154 is closed, a product within the container 152 rests on the door 154 and may be weighed by the weighing apparatus. In this respect, the container 152 and door 154 may together serve as a weighing hopper. When the door 154 is open, a product is able to fall under gravity into the forming chute 141. The door 154 may take any suitable form, e.g. a slidable or hinged door with one or more slidable or hinged leaves, and is operable between its open and closed states by any suitable actuating mechanism (not shown), conveniently under the control of the controller 119. Alternatively, the door 154 may be integrated with the container 152.

In the preferred embodiment, the container 152 is movable between a first position (shown in FIG. 6) in which is located above and in register with the upper end of the forming chute 141, and a second position (not illustrated) in which it is located above and in register with a reject chute 156. The container 152 may be moved by any suitable actuating mechanism, for example a linear actuator 158, conveniently under the control of controller 119. Conveniently, the actuating mechanism effects a sliding movement of the container 152 as indicated by arrow A. A product may be sent to the reject chute 156 if the sizing apparatus 121 indicates that it is too big or too small, and/or if the weighing apparatus indicates that it is too heavy or too light.

Alternatively, the container 152 is positioned out of register with the upper end of the chute 141 until it is appropriate to feed the product into the chute 141 at which time the container 152 is moved into register with the upper end of the chute 141 (in which case the door 154 may be omitted). If the door is omitted then the platform 117 may support the product as the container 152 moves.

In the illustrated embodiment, the product is weighed while it is being held in the container 152. In alternative embodiments (not illustrated) the weighing platform is located at the end 130 of conveyor 128, and is advanced to fall into the container 152 after being weighed. The advantage of this arrangement is that because the product does not fall onto the weighing platform, little or no settling time is required before weighing can take place.

More generally, the container 152, together with the door 154 and/or platform 117 as applicable, serve as a holding mechanism for holding the product during its weighing cycle (which may be during or after the act of weighing by the weighing apparatus) and passing it to the forming chute 141 at the end of the weighing cycle. In the preferred embodiment, the door 154 forms part of means for transferring the product to the packaging apparatus 140. In alternative embodiments, the container 152, together with the door 154 and/or platform 117 as applicable may form part of the means for transferring the product to the packaging apparatus 140. The chute 141 may also be considered as part of means for transferring the product to the packaging apparatus, in particular to the location at which they are packaged, namely the lower end of the chute 141.

Means for transferring products from the end 130 of the conveyor 128 to the container 152 are provided, conveniently comprising guide rods 160, although any other suitable guiding device, e.g. chute or slide, could be used.

Figure 7:
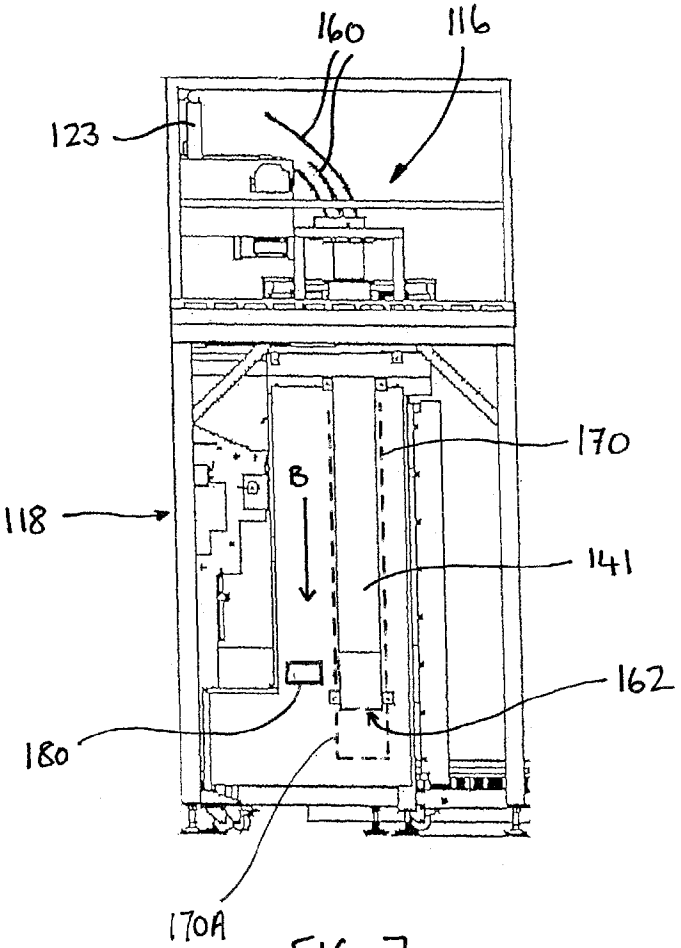
FIG. 7 is a side view of a packaging station being part of the apparatus of FIG. 4.

A bagging device 162 is provided at the lower end of the forming chute 141. The preferred bagging device 162 comprises retaining means operable between a closed state (as illustrated in FIG. 7) and an open state. In the closed state, a product may be retained inside the forming chute 141 by the device 162. In the open state, the product is able to drop out of the chute 141 under gravity. The chute 141 is typically substantially vertical during use, but may take other dispositions provided the product is able to fall through the chute in a direction from the upper end to the lower end. The preferred bagging device 162 is configured to provide three main functions: firstly to selectively retain or release the product with respect to the lower end of the chute 141; secondly to close packaging material 170 as part of a bag forming process that is described in more detail hereinafter; and thirdly to sever the packaging material to create separate bags or packages. Preferably, the bagging device 162 is configured to form a transverse seal, preferably a heat seal, across the sleeve to close the packaging material. To this end, the bagging device 162 preferably comprises a heat sealing device, conveniently comprising a pair of opposable jaws. In the preferred embodiment, the opposable jaws also provide the retaining means, and may also include cutting edges to provide the severing function. Hence, the bagging device 162 may be operable to open or close the lower end of chute 141, form a seal across the sleeve to serve as one end of a bag, and/or sever a sealed section of the packaging material from the sleeve. Alternatively, the device 162 may comprise a separate door or other barrier to provide the retaining means, a separate sealing device and/or a separate cutter for severing the bags, each of which may be operable independently of the other. The operation of the bagging device 162 is controlled by the controller 119 as is described in more detail hereinafter.

Figure 8:
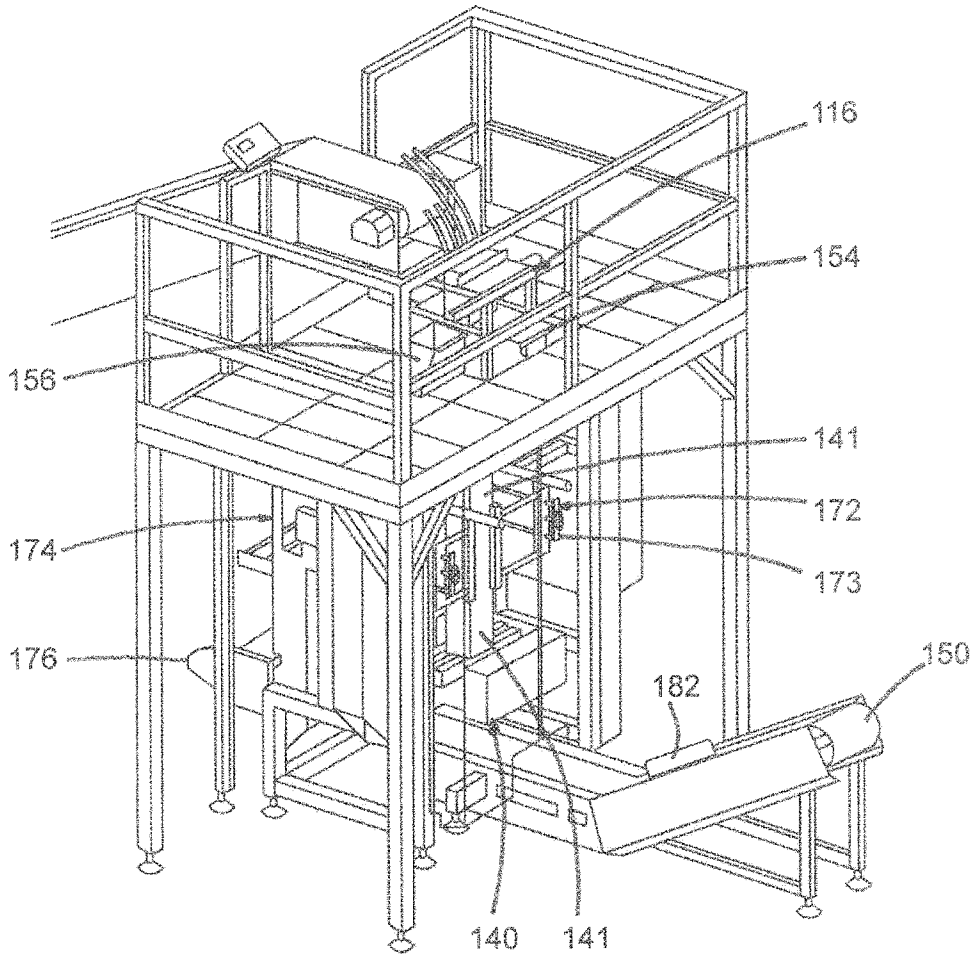
FIG. 8 is a perspective view of the packaging station of FIG. 7.

As can best be seen from FIG. 8, the packaging station 118 includes a forming apparatus 172 that is co-operable with a dispensing apparatus 174 to feed packaging material 170 along the forming chute 141 (in the direction indicated by arrow B in FIG. 7) and to form the packaging material into a sleeve around the outside surface of the chute 141. The forming apparatus 172 is not shown in FIGS. 4 to 7 for reasons of clarity. The packaging material typically starts in sheet form on a roll (not shown) mounted on a holder 176. The dispensing apparatus 174 is configured to draw the packaging material from the roll and feed it to the forming apparatus 172. The forming apparatus 172 gathers the packaging material and forms it into a sleeve around the chute 141. To this end, the apparatus 172 may comprise a suitably shaped frame 173 located around the chute 141. One or more rollers may be provided as required to guide the packaging material between the dispensing apparatus 174 and forming apparatus and/or through the forming apparatus 172. Advantageously, the forming apparatus 172 includes a sealing device, preferably a heat sealing device, configured to form a seal along the edges of the packaging material, when brought together to form the sleeve shape, in order to form the sleeve. Conveniently, the sealing device is static with respect to the chute 141 and forms the seal as the packaging material is feed past it. The dispensing apparatus 172 and the forming apparatus 172 are controlled by the controller 119, in particular to control the timing with which the sleeve of packaging material 170 is feed along the forming chute 141. In the preferred embodiment, the dispensing apparatus 172, the forming apparatus 172, and the bagging device 162 are the main components of the packaging apparatus 140. The chute 141 may also be considered as part of the packaging apparatus since it facilitates forming the packaging as described above, although it also performs the function of transferring the products to the packaging apparatus 140, in particular to the location at which they are packaged, namely the lower end of the chute 141.

A packaging station 118 includes a printer which is represented in the drawings by a printer head 180. The printer head 180 is positioned to print information onto the packaging material 170 at a location adjacent the lower end of the forming chute 141. In particular, the printer head 180 is positioned to print information onto the packaging material 170 at a location that is above the bagging device 162 by an amount that does not exceed the length of the bags 182 that are formed by the packaging apparatus 140.

In use of the preferred embodiment, as each product in turn reaches the upper end 130 of conveyor 128 it is checked by the sizing apparatus 121 and the controller 119 determines if it is outside of the pre-determined size limit(s). The product is then advanced to the edge of the conveyor 128 whereupon it falls under gravity and guided by the rods 160 into the container 152, the door 154 being closed to retain the product in the container 152. The weighing apparatus weighs the product and the weight is recorded by the controller 119. The door 154 is then opened to allow the product to fall down the chute 141, the bagging device 162 being closed to retain the product at the lower end of the chute 141.

After the product has been weighed, data indicating the weight (together with any other desired information) is printed, by printer 180 under control of controller 119, onto a section of the packaging material 170 that is to be used to package the (same) product. Advantageously, the relevant section of packaging material is that which is next to be formed into a bag or other package. Typically this is the end, i.e. lowest section, of the sleeve of packaging material. Preferably, it is the section of packaging material that is located around the lower end of the chute 141. Printing may occur before, after and/or simultaneously with the product being released into the chute 141. In any event, the weight of the product is printed onto the packaging material at least before the next product is released into the chute 141 and preferably before the next product is weighed. The preferred arrangement is such that, during at least part of the packaging cycle when the product is located at the lower end of the chute 141, its corresponding weight (and any other information that is desired) is printed on the section of packaging material that surrounds the lower end of the chute 141 and is in register with the product. It is noted that, at this stage, the packaging material has not yet been formed into a bag, i.e. the printing has taken place before the bag or other final product package is created.

Once printing is finished, the next step is to put the product into the correspondingly printed section of packaging material and transform it into a bag (or package) containing the product. A seal is formed across the packaging material by the bagging device 162. Typically, this seal will have already been formed by the bagging device 162 when it last closed. The seal defines one end of the bag into which the product is to be placed. The controller 119 causes the dispensing apparatus 174 and forming apparatus 172 to advance the sleeve of packaging material (in the direction indicated by arrow B in FIG. 7) such that the section 170A that is to form the bag for the product is below the lower end of the chute 141, as illustrated in FIG. 7. The bagging device 162 is operated to release the product so that it may leave the chute 141 under gravity and so enter the section of packaging material below the chute 141. The packaging material may be advanced first, in which case the product is dropped into the packaging material, or afterwards in which case the product is lowered out of the chute 141 by the packaging material. The bagging device 162 is then operated to form a seal across the packaging material, which seal defines the other end of the bag 182. The bagging device 162 severs the bag 182 from the sleeve of packaging material, leaving a seal across the sleeve at the lower end of the chute 141, which seal defines one end of the next bag to be formed. The bagging device 162 closes the lower end of the chute 141 ready to retain the next product. In the preferred embodiment, the sealing, severing and closing is performed in one operation by closing the bagging device 162.

Accordingly, the apparatus 110 performs, for each product, a combined weighing and packaging cycle in which the product is weighed, the weight (and any other required data) is printed onto packaging, and a package (bag) is formed from the printed packaging into which the respective product is inserted. This ensures that the data on the package matches the contents of the package. Advantageously, the product is weighed after the preceding product has been packaged (or at least placed into or otherwise allocated to its respective packaging) such that no other non-packaged products are in the packaging production line between the weighing apparatus and the packaging apparatus. Hence, the weighed product is the next to be packaged and so the weight-related information provided to the printer relates to the product next being packaged. In an alternative embodiment, the retaining part of the bagging device 162 may be omitted, or left open when the product is dropped into the chute 141 from the weighing station 116, in which case the seal across the packaging sleeve serves as the retaining means for the product. For example, the product may be dropped from the upper end of the chute 141 onto the seal when the seal is located at the lower end of the chute, in which case the operation of the apparatus maybe the same as described above apart from the opening and closing of retaining means. Alternatively, the section of the packaging that is to form the bag may be advanced beyond the end of the chute before the product is released from the weighing station. Such configurations are however better suited to packaging relatively light products since heavier products may damage the seal upon impact. In either case, the printing may be performed after the packaging is advanced beyond the end of the chute 141, in which case the printer 180 is relocated to print on packaging below the chute 141. It is preferred however to print on the packaging material while in register with the chute 141 to provide a support surface for printing.

The printer may comprise a thermal transfer coder, e.g. the 3i (trade mark) thermal transfer coder provided by Markem-Imaje Ltd. of Salford, England. The printer may be configured to print any required information onto the bag, e.g. price, product weight, cooking time and/or best before/sell by dates. The information is conveniently printed directly onto the surface of the bag/packaging material. Since the product is weighed just before being packaged, it is ensured that the information printed onto a bag relates to the specific product in the bag. This is particularly important in relation to the weight of the product. The printer may conveniently be controlled by the aforementioned system controller.

The packaging station 18, 118 may also, or alternatively, be provided with a labelling apparatus (not shown) for applying labels, especially adhesive labels, to the packaging material and/or bags. The labels may be pre-printed (e.g. relating to a retailer, a product source or a promotion). Alternatively, the labels may be printed at the packaging station 18, 118 with information, e.g. weight, relating to a respective product being packaged. In this case, the labelling apparatus includes, or is co-operable with a printer, e.g. printer 180. In such embodiments, the printer prints the relevant information onto a label for each product during the weighing and packaging cycle, and the label is applied to the packaging material in the same way as described in the embodiments above, i.e. an indirect printing process to replace or supplement the direct printing described above. The labelling apparatus may conveniently be controlled by the aforementioned system controller.

A conveyor 50, 150, e.g. a belt conveyor, is typically provided for conveying packaged products 182 away from the packaging station 18, 118.

In preferred embodiments, the packaging apparatus 40, 140 is configured to make a hermetically sealed 4 corner package (especially of the type known as a quad seal bag), and advantageously includes means for injecting a product preserving gas into the package, e.g. at a level that will satisfy a shelf life of 12-14 days. The package comprises a bag formed from one or more sheets of plastics, e.g. a laminated plastics film. In use, products to be packaged, e.g. fresh, tied tray-less chickens or other poultry products, are provided to the packing apparatus from an indexed conveyor system. Each product is weighed, after which it is conveyed via gravity into a forming tube of the packaging apparatus. The package is printed with relevant information, e.g. product weight, date, time, bar code and/or batch code, as required.

The invention is not limited to the embodiment(s) described herein but can be amended or modified without departing from the scope of the present invention.

The invention claimed is:

1. A packaging system for individually packaging a succession of products in a production line using packaging material, the system comprising a packaging apparatus, a weighing apparatus, at least one conveyor for delivering products to the weighing apparatus, a printer, and transferring means for transferring a weighed product to said packaging apparatus, and wherein said printer is arranged to receive information relating to the weight of said weighed product and to print said information, or information derived therefrom, directly onto the packaging material for the weighed product, the system further comprising a computerised controller for controlling the operation of the packaging apparatus, the weighing apparatus, the at least one conveyor and the printer, the controller being configured to implement a succession of weighing and packaging cycles, a respective one cycle for each of said products, wherein in each of said cycles a respective one of said products is weighed, the respective packaging is printed, and said respective one of said products is packaged with the respective printed packaging, and wherein said weighing apparatus is located adjacent said packaging apparatus such that, in each of said cycles, the product that is weighed during said cycle is the next product to be packaged by said packaging apparatus, wherein said transferring means comprises a chute arranged to transfer products from the weighing apparatus under the influence of gravity, a bagging device is located at a lower end of said chute, and wherein the bagging device includes a retaining means for retaining said weighed product in said chute, wherein the packaging system further includes a packaging material dispensing apparatus operable to dispense said packaging material along the outside of said chute, said packaging material being provided as a sleeve around said chute, wherein said printer is configured to print onto a section of said packaging material that is in register with said lower end of the chute, and wherein in respect of each cycle said controller is configured to cause said printer to print said information onto a section of said packaging material that is in register with the lower end of said chute and subsequently to cause said dispensing apparatus to feed said packaging material along said chute by an amount corresponding to the length of a package for said product, and to cause said retaining means to release said weighed product from said chute.

2. A packaging system as claimed in claim 1, wherein said packaging apparatus is configured to package said weighed product after said printing is performed.

3. A packaging system as claimed in claim 1, wherein said bagging device comprises a sealing device configured to form a seal across a section of said packaging material located in use at said lower end of said chute.

4. A packaging system as claimed in claim 1, wherein the bagging device includes a severing device for severing said packaging material at said seal.

5. A packaging system as claimed in claim 1, wherein said package material dispensing apparatus is operable to dispense said packaging material in increments in which a pre-determined length of packaging material is dispensed.

6. A packaging system as claimed in claim 1, wherein said packaging apparatus further includes a package material forming apparatus configured to cause said packaging material to form a sleeve.

7. A packaging system as claimed in claim 6, wherein said forming apparatus is configured to cause said packaging material to form a sleeve around the outside of said chute.

8. A packaging system as claimed in claim 7, wherein said dispensing apparatus and said forming apparatus are co-operable to feed said sleeve of packaging material along the outside of said chute.

9. A packaging system as claimed in claim 1, further including a holding mechanism for holding each product during a respective weighing cycle, the holding mechanism being operable to pass the held product to the packaging apparatus at the end of the weighing cycle.

10. A packaging system as claimed in claim 9, wherein said holding mechanism comprises a door operable between a closed state in which it allows the holding mechanism to retain the product, and an open state in which it allows the product to pass to the packaging apparatus.

11. A packaging system as claimed in claim 9, wherein said holding mechanism comprises a container for said product, said container having an open upper end for receiving said product.

12. A packaging system as claimed in claim 11, wherein said container is movable into and out of a position where it is in register with said chute.

13. A packaging system as claimed in claim 12, wherein said holding mechanism comprises a door operable between a closed state in which it allows the holding mechanism to retain the product, and an open state in which it allows the product to pass to the packaging apparatus and wherein said door is positioned and configured to open or close said chute.

14. A packaging system as claimed in claim 11, wherein said container is movable into and out of a position where it is in register with a reject chute.

15. A packaging system as claimed in claim 9, wherein said weighing apparatus is coupled to said holding mechanism in order to weigh a product held by said holding mechanism.

16. A packaging system as claimed in claim 1, wherein said weighing apparatus is located above said packaging apparatus and at or below an end of a feed conveyor.

17. A packaging system as claimed in claim 1, wherein said controller is configured to implement said cycles such that each respective product is weighed after the packaging for the preceding product is printed.

18. A packaging system as claimed in claim 1, wherein said bagging device comprising a sealing device configured to form a seal across a section of said packaging material located in use at said lower end of said chute, and wherein in respect of each cycle said controller is configured to cause said sealing device to form a seal across said packaging material after said packaging material is fed along said chute.

19. A packaging system as claimed in claim 1, wherein said bagging device comprises a sealing device configured to form a seal across a section of said packaging material located in use at said lower end of said chute.

20. A packaging system as claimed in claim 1, said bagging device comprising a sealing device configured to form a seal across a section of said packaging material located at said lower end of said chute, the bagging device including a severing device for severing said packaging material at said seal and wherein in respect of each cycle said controller is configured to cause said severing device to sever said packaging at said seal.

21. A packaging system as claimed in claim 20, wherein in respect of each cycle said controller is configured to cause said retaining means to release said product before said severing device is caused to sever said packaging.

22. A packaging system as claimed in claim 1, wherein said packaging apparatus comprises a forming apparatus configured to form said packaging material into a bag having sealed ends.

23. A packaging system as claimed in claim 22, wherein said forming apparatus is configured to fold the sides of the packaging material to create two substantially parallel edges running substantially parallel with said transferring means.

24. A packaging system as claimed in claim 1, wherein said at least one conveyor includes an elevating conveyor arranged to elevate the products to a height from which they may be transferred to the weighing apparatus.

25. A packaging system for individually packaging a succession of products in a production line using packaging material, the system comprising a packaging apparatus, a weighing apparatus, at least one conveyor for delivering products to the weighing apparatus, a printer, and transferring means configured to transfer a weighed product to said packaging apparatus, and wherein said printer is arranged to receive information relating to the weight of said weighed product and to print said information, or information derived therefrom, directly onto the packaging material for the weighed product, the system further comprising a computerised controller for controlling the operation of the packaging apparatus, weighing apparatus, the at least one conveyor and the printer, the controller being configured to implement a succession of weighing and packaging cycles, a respective one cycle for each of said products, wherein in each of said cycles a respective one of said products is weighed, the respective packaging is printed, and said respective one of said products is packaged with the respective printed packaging, and wherein said weighing apparatus is located adjacent said packaging apparatus such that, in each of said cycles, the product that is weighed during said cycle is the next product to be packaged by said packaging apparatus, wherein said transferring means comprises a chute arranged to transfer products from the weighing apparatus under the influence of gravity, a bagging device is located at an in use lower end of said chute, and wherein the bagging device includes retaining means for retaining said weighed product at the lower end of said chute, wherein the packaging system further includes:

a packaging material dispensing apparatus operable to dispense said packaging material along the outside of said chute, said packaging material being provided as a sleeve around said chute, wherein said printer is configured to print onto a section of said packaging material that is in register with said lower end of the chute;

and wherein in respect of each cycle said controller is configured to cause said printer to print said information onto said section of said packaging material that is in register with the lower end of said chute and subsequently to cause said dispensing apparatus to feed said packaging material with said one or more labels along said chute by an amount depending on a length of a package for said product, and to cause said retaining means to release said weighed product from said chute.

26. A method of individually packaging a succession of products in a production line using packaging material and a packaging system comprising a packaging apparatus, a weighing apparatus, at least one conveyor for delivering products to the weighing apparatus, a printer and a computerised controller for controlling the operation of the packaging apparatus, said weighing apparatus, said at least one conveyor and said printer, wherein said weighing apparatus is located adjacent said packaging apparatus, and wherein said packaging apparatus including a bagging device located at a lower end of said chute, and wherein the bagging device includes retaining means for retaining the weighed product at said lower end of said chute, said method comprising weighing a product using said weighing apparatus; transferring the weighed product to said packaging apparatus wherein said transferring is via a chute arranged to transfer products from the weighing apparatus under the influence of gravity; causing said retaining means to retain said weighed product at said lower end of said chute; and causing said printer to print information relating to the weight of said weighed product, or information derived therefrom, directly onto a section of the packaging material for the weighed product that is in register with said lower end of said chute; subsequently feeding said packaging material along said chute by an amount depending on a length of a package for said product; and causing the controller to implement a succession of weighing and packaging cycles, a respective one cycle for each of said products, wherein in each of said cycles a respective one of said products is weighed, the respective packaging is printed, and said respective one of said products is packaged with the respective printed packaging; and causing, in each of said cycles, said product that is weighed during said cycle to be the next product packaged by said packaging apparatus with no other non-packaged products being in said production line between the weighing apparatus and the packaging apparatus.

27. The packaging system of claim 25, wherein said retaining means is operable between a closed state and an open state wherein, in the closed state, said weighed product is retained at said lower end of said chute, and in the open state said weighed product is released from the lower end of said chute, and wherein in respect of each cycle said controller is configured to cause said retaining means to retain the weighed product at the lower end of said chute and subsequently to release the weighed product.

28. The packaging system of claim 1, wherein said retaining means is operable between a closed state and an open state wherein, in the closed state, said weighed product is retained at said lower end of said chute, and in the open state said weighed product is released from the lower end of said chute, and wherein in respect of each cycle said controller is configured to cause said retaining means to retain the weighed product at the lower end of said chute and subsequently to release the weighed product.

* * * * *